US007096633B1

(12) United States Patent
Bowen

(10) Patent No.: US 7,096,633 B1
(45) Date of Patent: Aug. 29, 2006

(54) METHOD OF HANGING A FALSE CLOTH CEILING

(76) Inventor: John Bowen, 29809 Riverside Bay Ct., Harrison Township, MI (US) 48045

( * ) Notice: Subject to any disclaimer, the term of this patent is extended or adjusted under 35 U.S.C. 154(b) by 73 days.

(21) Appl. No.: 10/814,521

(22) Filed: Mar. 31, 2004

(51) Int. Cl.
*E04B 9/00* (2006.01)
*E04B 9/18* (2006.01)
*E04B 9/22* (2006.01)

(52) U.S. Cl. ..... 52/506.06; 52/506.08; 52/506.09; 52/476; 52/762; 52/772; 52/775

(58) Field of Classification Search ..... 52/506.06, 52/506.08, 506.09, 506.03, 506.04, 474, 52/762, 718.04, 475.1, 476, 772, 775; 40/603–604; 160/368.1, 327, 395
See application file for complete search history.

(56) References Cited

U.S. PATENT DOCUMENTS 1,997,582 A * 4/1935 Heeren et al. ..... 52/145
2,059,483 A * 11/1936 Parsons ..... 52/506.06
2,527,031 A * 10/1950 Rambusch ..... 362/150
2,818,235 A * 12/1957 Baran ..... 165/56
3,030,670 A * 4/1962 Bigelow ..... 52/650.3
3,088,025 A * 4/1963 Deaton ..... 362/354
3,161,162 A * 12/1964 Homolya ..... 110/331
3,256,664 A * 6/1966 Brunnzell ..... 52/478
3,844,080 A 10/1974 Brock et al. ..... 52/222
3,951,197 A * 4/1976 Cohen et al. ..... 160/346
4,103,401 A * 8/1978 Conley ..... 24/462
4,112,643 A * 9/1978 Decker ..... 52/222
4,200,171 A 4/1980 Seymour et al. ..... 181/287
4,210,070 A 7/1980 Tatum et al. ..... 98/40
4,390,055 A * 6/1983 Fenley ..... 160/348
4,408,433 A 10/1983 Scherrer ..... 52/738
4,660,308 A * 4/1987 Dang et al. ..... 38/102.4
4,711,060 A 12/1987 Scherrer ..... 52/222
4,835,914 A 6/1989 Scherrer ..... 52/28
4,863,127 A * 9/1989 Handler ..... 248/205.2
4,879,854 A * 11/1989 Handler ..... 52/238.1
4,887,338 A * 12/1989 Handler ..... 24/306
4,887,626 A 12/1989 Dalo et al. ..... 135/119
4,894,960 A 1/1990 Hill et al. ..... 52/28
4,938,819 A 7/1990 Ishii et al. ..... 156/76
4,986,332 A 1/1991 Lanuza ..... 160/327
5,029,422 A 7/1991 Scherrer ..... 52/222
5,034,042 A 7/1991 Allen, Jr. ..... 55/385.2
5,058,340 A 10/1991 Muller ..... 52/222
5,090,163 A 2/1992 New ..... 52/39
5,209,029 A 5/1993 Foerst ..... 52/63
5,224,306 A 7/1993 Cramer ..... 52/63
5,345,989 A * 9/1994 Brophy ..... 160/354
5,413,300 A 5/1995 Hosteing ..... 248/317

(Continued)

*Primary Examiner*—Jeanette E. Chapman
(74) *Attorney, Agent, or Firm*—Young & Basile, P.C.

(57) ABSTRACT

A false ceiling having flexible material connected to an elongate U-shaped beam or rail, the beam fixedly connected to existing trusses via clamps. The U-shaped beam has a pair of vertical flanges with inner surfaces for receiving an end portion of the flexible material. Strips of hook-and-loop material are fixed on the inner surfaces of the vertical flanges for gripping corresponding hook-and-loop material strips on the end portions of the flexible material. Lightweight foam blocks are sized to tightly fit between the pair of vertical flanges to assist the connection of the hook-and-loop material strips on the flexible material to the vertical flanges. A decorative cap is connected to the beam to cover the connections of the beam to the truss and to the flexible material.

8 Claims, 1 Drawing Sheet

U.S. PATENT DOCUMENTS 5,475,962 A * 12/1995 Horsten et al. ..... 52/506.08
5,533,306 A 7/1996 Aspenson ..... 52/144
5,768,843 A * 6/1998 Dziedzic ..... 52/506.06
5,784,847 A * 7/1998 Wiklund ..... 52/506.07
6,056,035 A * 5/2000 Laster-Bivens ..... 160/84.01
6,164,364 A 12/2000 Morris ..... 160/327
6,192,962 B1 * 2/2001 Glover ..... 160/126
6,199,337 B1 3/2001 Colson et al. ..... 62/273
6,511,522 B1 * 1/2003 Gomez et al. ..... 55/385.2
6,659,159 B1 * 12/2003 Fritsche et al. ..... 160/371
6,701,586 B1 * 3/2004 Conley et al. ..... 24/460
6,802,357 B1 * 10/2004 Taylor et al. ..... 160/371
6,925,681 B1 * 8/2005 Lin ..... 16/87 R
6,955,022 B1 * 10/2005 Imam ..... 52/660
2002/0194802 A1 12/2002 Cousin
2003/0163966 A1 9/2003 Reynolds et al. ..... 52/461

* cited by examiner

METHOD OF HANGING A FALSE CLOTH CEILING

BACKGROUND OF THE INVENTION

The present invention relates to a false cloth ceiling and a method of hanging the ceiling.

False ceilings using a fabric material are widely used in large entertainment halls, exhibition halls, conference halls, etc. to cover unsightly structural ceilings including the structural beams, electrical and hydraulic components, as well as heating and the air conditioning pipes that are suspended from the structural ceiling. Existing false ceilings consist of a frame suspended from and connected to the structural ceiling or one of the existing beams or trusses. The fabric material is then stretched horizontally for connection within the frame. The fabric material is generally maintained taut to represent a flat ceiling by firmly fastening the edges of the material to the frame.

One disadvantage of existing false ceilings is that the connectors and fastening means for the fabric material is visible at the rail. Another disadvantage is that some existing false ceilings require multiple components for their installation and/or require specifically designed rail systems having intricate configurations for supporting the fabric material. As a result, the installation of those existing false cloth ceilings are labor intensive or the manufacturing of the rails is expensive.

It is therefore desirable to provide a false ceiling which is aesthetically pleasing by hiding the fastening means of the ends of the fabric material to the rails. It is also desirable to provide a false ceiling that is easily and quickly installed and which minimizes labor and manufacturing costs.

SUMMARY OF THE INVENTION

The present invention addresses the aforementioned concerns by providing a false ceiling for a room having vertical walls with trusses that extend between the walls, wherein the false ceiling comprises an elongate U-shaped member defining a rail having a pair of spaced flanges connected by a central flange. The rail has a plurality of elongated through slots formed in the central flange. The false ceiling further includes a means for connecting the U-shaped member to a truss wherein the elongate through slots allow selective positioning of the U-shaped member to the truss. The false ceiling further includes flexible material fastened along an interior surface of one of the pair of spaced flanges.

In another aspect of the invention, the false ceiling further includes attachment means secured to the interior sides of the pair of spaced flanges and edges of the flexible material for securing the flexible material to the interior surfaces of the spaced flanges.

In yet another aspect of the invention, the false ceiling includes a block of foam material sized to tightly fit between the interior surfaces of the pair of spaced flanges for further securing the flexible fabric material to the interior surfaces of the U-shaped member.

Further, the connecting means of the false ceiling may include a clamp encircling the truss and a nut and bolt combination, wherein the bolt extends through a portion of the clamp and through one of the elongate slots and the nut is secured to the bolt between the pair of spaced flanges.

In another aspect of the invention, the attachment means includes strips of a hook-and-loop material which are secured to the interior surfaces of the pair of spaced flanges and to the edges of the flexible material.

Further, in another aspect of the invention, a decorative cap may be provided which is adapted for attachment to span over the pair of spaced flanges for hiding the attachment means therein.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Most false ceiling systems are connected directly to a horizontal ceiling. However, there are certain instances where it is desirable to provide a false ceiling that is significantly lower than the existing structural ceiling. This is particularly preferable in such venues as exhibition halls, conference halls, and the like where the halls have very high ceilings and structural trusses, beams and other components are located below the existing structural ceiling. The present invention provides a false ceiling connectible to the aforementioned trusses 12.

Figure 1:
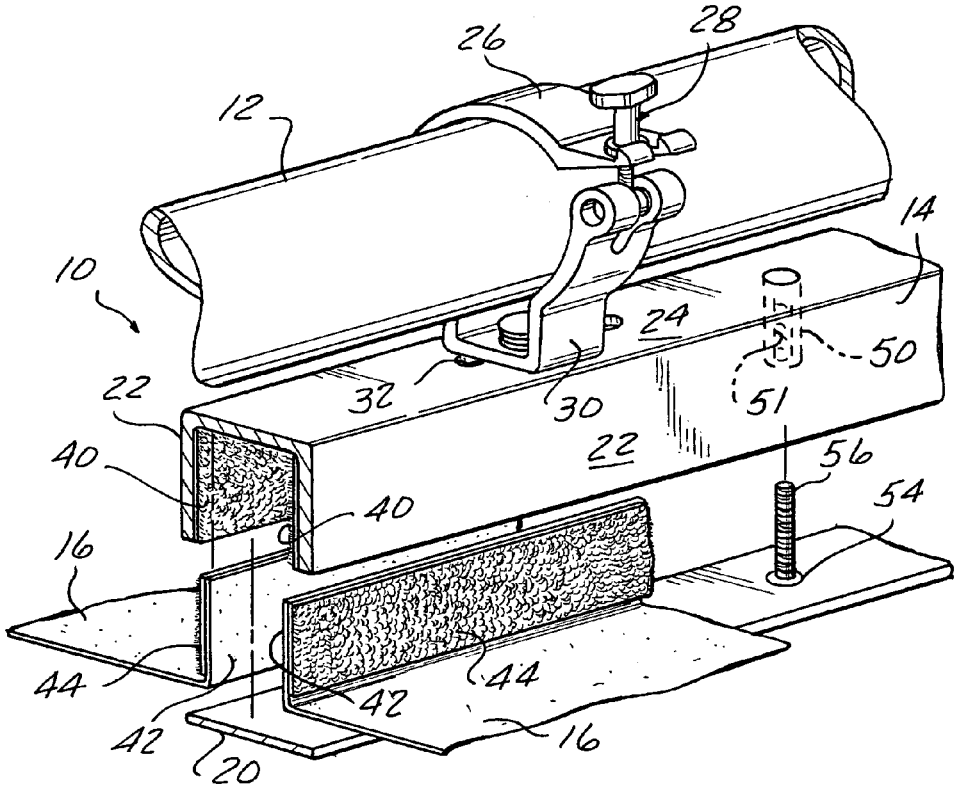
FIG. 1 is a partial view in perspective of the system for hanging a false cloth ceiling having a rail and a decorative cap according to the present invention.
Figure 2:
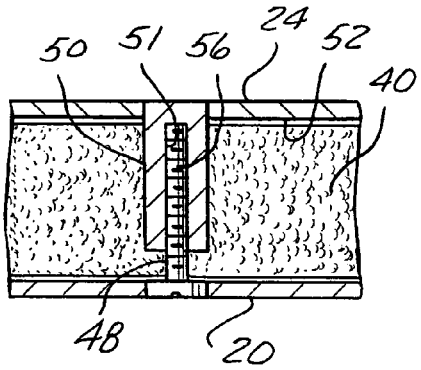
FIG. 2 is a sectional view of the system for the false ceiling showing a foam block positioned between vertical flanges of the rail.
Figure 3:
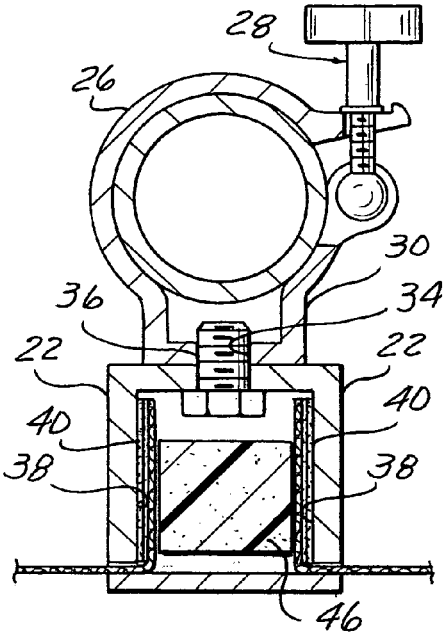
FIG. 3 is a sectional view showing the connection of the decorative cap to the rail.

Referring to FIGS. 1–3, there is shown a false ceiling system 10 according to the present invention connected to a truss 12. The false ceiling system 10 of the present invention includes a rail 14, a means for connecting the rail to the truss 12, flexible fabric material 16, means for connecting the flexible fabric material 16 to the rail 14, and a decorative cap 20 to close a lower portion of the rail 14 as will be discussed hereinafter.

The rail 14 essentially has a U-shaped configuration, including a pair of parallel flanges 22 spaced by a center portion 24. The parallel flanges 22 have equal lengths; and the rail 14 is positioned beneath the truss 12 and orientated so that the pair of parallel flanges 22 are vertically orientated and extend from the center portion 24 of the rail 14. The center portion 24 is positioned adjacent to the truss 12 for connection thereto. The U-shaped rail 14 is connected to a truss 12 by means of a clamp 26. The clamp 26 is an available C-clamp having a corresponding diameter to encircle around the truss 12. The C-clamp 26 is closed at one side by conventional means using a bolt and nut configuration 28. The C-clamp 26 has an extended portion 30 which extends away from the truss 12 when the C-clamp 26 encircles the truss 12. The extended portion 30 of the C-clamp 26 is positioned to be facing the floor (not shown) of the hall or building. The center portion 24 of the rail 14 is then positioned adjacent the extended portion 30 for connection thereto. To facilitate connection between the rail 14 and the clamp 26, the rail 14 has a plurality of elongate through slots 32 that are centrally located and spaced along the center horizontal portion 24 of the rail 14. The extended portion 30 of the C-clamp has an aperture 34 therethrough for coinciding with one of the slots 32 in the rail 14. The slot 32 in the rail 14 is elongate to provide movement of the rail 14 relative to the truss 12 for exact positioning of the rail 14 for the false ceiling 10. The extended portion 30 of the C-clamp 26 is connected to the rail 14 by way of a nut and bolt combination 36 which extends through the slot 32 and aperture 34 as shown in FIG. 2.

The flexible fabric material 16 is connected to the interior surfaces 38 of the vertical flanges 22 of the rail 14. The interior surfaces 38 of the vertical flanges 22 include a strip of a hook-and-loop material 40. One such hook-and-loop material is sold under the trademark Velcro®. Preferably, the hook-and-loop material 40 extends on both interior surfaces 38 for the entire length of the rail 14. The hook-and-loop material strip 40 is applied to each interior surface 38 of the flanges 22 by an adhesive that is coated on one side of the hook-and-loop material strip 40. Each sheet of flexible fabric material 16 has an edge portion 42 adapted for connection to the hook-and-loop material 40 within the rail 14. The edge portion 42 is provided with a corresponding strip of a hook-and-loop material 44. The strip of hook-and-loop material 44 on the fabric 16 is preferably connected to the edge 42 of the fabric along its entire length. The hook-and-loop material 44 will also preferably have an adhesive backing for securing to the edge portion 42 of the fabric 16. The hook-and-loop strips 40, 44 on the inside surfaces of the rails 14 and along the edges 42 of the fabric material 16 fastens the flexible material 16 to the rail 14. To further maintain the adherence of the fabric material 16 to the inside surfaces 38 of the rail 14, blocks of lightweight foam 46 may be wedged between the pair of vertical flanges 22 of the rail 14 after the edges 42 of the flexible material 16 have been connected to the interior surfaces 38 of the rail 14. The block of lightweight foam 46 is sized to fit snugly between the two vertical flanges 22 so that the foam block 46 places an outward force against the pair of vertical flanges 22 to bond the hook-and-loop material strips 40, 44 together. A plurality of the foam blocks 46 may be spaced along the entire length of the rail 14. This procedure will be conducted for each of two or more edges 42 of the fabric material 16 so that the fabric material 16 is stretched tautly to cover exposed pipes and other components located near the structural ceiling.

Once the false ceiling 10 is secured to the trusses 12, a decorative cap 20 is attached to the rail 16 to close the lower portion of the rail 14. The decorative cap 20 hides the hook-and-loop connections of the fabric to the inside surfaces 38 of the vertical flanges 22 as well as the rail 14 connection to the truss 12 to provide a more aesthetically pleasing ceiling. The cap 20 preferably extends the entire length of the rail 14, although more than one cap 20 may be used to cover the length of the rail 14. Looking at FIGS. 1 and 3, the cap 20 is connected to the rail 14 via a nut and bolt connection 48. A dowel 50 having an interior threaded cavity 51 extends at predetermined locations from the inner surface 52 of the center portion 24 of the rail 14. The decorative cap 20 has apertures 54 therein positioned to correspond to at least some of the predetermined locations of the dowel. A decorative cap 20 is positioned over the rail 14 so that at least some of its apertures 54 align with the dowels 50 in the rail 14. After the decorative cap 20 is positioned over the rail 14, a bolt 56 is inserted into the apertures 54 and threaded into the inside cavity 51 of the dowel 50.

This invention provides a simple and easily installed false ceiling using components that are readily available or inexpensive to manufacture. Further, the components used to provide the false ceiling can be quickly installed and later disassembled to minimize labor costs.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. For example, the rail 14 may be connected to an I-beam or another structural component having a configuration other than tubular by a clamp with a corresponding shape.

What is claimed is:

1. A false ceiling for a room having walls and trusses extending between the walls, the false ceiling comprising:

an elongate U-shaped member defined by a pair of spaced flanges connected by a center portion, said center portion having a plurality of elongate slots therein;

means for connecting the U-shaped member to a truss, wherein the elongate slots allow the connecting means selective positioning relative to the U-shaped member;

flexible material fastened along an interior surface of one of the pair of spaced flanges;

attachment means secured to the interior surfaces of the pair of spaced flanges for securing the flexible material thereto; and a block material sized to tightly fit between the interior surfaces of the pair of spaced flanges for further securing the flexible fabric material to the interior surfaces of the U-shaped member.

2. A false ceiling for a room having walls and trusses extending between the walls, the false ceiling comprising:

an elongate U-shaped member defined by a pair of spaced flanges connected by a center portion, said center portion having a plurality of elongate slots therein;

means for connecting the U-shaped member to a truss, wherein the elongate slots allow the connecting means selective positioning relative to the U-shaped member;

flexible material fastened along an interior surface of one of the pair of spaced flanges;

attachment means secured to the interior surfaces of the pair of spaced flanges for securing the flexible material thereto; and a decorative cap adapted to be attached over the pair of spaced flanges for hiding the attachment means.

3. A false ceiling for a room having walls and trusses extending between the walls, the false ceiling comprising:

an elongate U-shaped member defined by a pair of spaced flanges connected by a center portion, said center portion having a plurality of elongate slots therein;

means for connecting the U-shaped member to a truss, wherein the elongate slots allow the connecting means selective positioning relative to the U-shaped member;

flexible material fastened along an interior surface of one of the pair of spaced flanges;

wherein the connecting means includes a clamp encircling the truss and a nut and bolt combination, wherein the bolt extends through a portion of the clamp and through one of the elongate slots and the nut is secured to the bolt between the pair of spaced flanges.

4. The false ceiling of claim 1, wherein the attachment means include hook-and-loop strips positioned on the at least one interior surface of the U-shaped member and on an edge of the fabric material.

5. The false ceiling of claim 1, wherein the block material is made of foam.

6. A false ceiling for a room having walls and trusses extending between the walls, the false ceiling comprising:

an elongate U-shaped member defined by a pair of spaced flanges connected by a center portion, said center portion having a plurality of elongate slots therein;

means for connecting the U-shaped member to a truss, wherein the elongate slots allow the connecting means selective positioning relative to the U-shaped member;

flexible material fastened along an interior surface of one of the pair of spaced flanges;

attachment means secured to the interior surfaces of the pair of spaced flanges for securing the flexible material thereto;

hook-and-loop strips secured to the interior surfaces of the pair of spaced flanges and corresponding hook-and-loop strips secured to edges of the flexible material for securing the flexible material to said flanges;

a block of foam material sized to tightly fit between the interior surfaces of the pair of spaced flanges for further securing the flexible material between the interior surfaces of the U-shaped member; and a decorative cap adapted for attachment over the pair of spaced flanges for hiding the attachment means, wherein the connecting means includes a clamp encircling the truss and a nut and bolt combination, wherein the bolt extends through a portion of the clamp and through one of the elongate slots and the nut is secured to the bolt between the pair of spaced flanges.

7. The false ceiling of claim 6, wherein the central flange of the U-shaped member has a dowel with an interior cavity extending between the pair of parallel flanges for threadably receiving a bolt extending into an aperture of the decorative cap.

8. The false ceiling of claim 3 further comprising a decorative cap adapted for attachment over the pair of spaced flanges for hiding the elongate slots.

* * * * *